US008907890B2

(12) United States Patent
Lai et al.

(10) Patent No.: US 8,907,890 B2
(45) Date of Patent: Dec. 9, 2014

(54) REMOTE CONTROL SYSTEM AND METHOD CAPABLE OF SWITCHING DIFFERENT POINTING MODES

(75) Inventors: Pei-Ling Lai, New Taipei (TW); Pin-Hsien Su, New Taipei (TW); Sung-Yu Hsieh, New Taipei (TW); Chun-Chieh Chen, New Taipei (TW); Ming-Hua Hung, New Taipei (TW)

(73) Assignee: Wistron Corporation, Hsichih, New Taipei (TW)

( * ) Notice: Subject to any disclaimer, the term of this patent is extended or adjusted under 35 U.S.C. 154(b) by 371 days.

(21) Appl. No.: 13/365,268

(22) Filed: Feb. 3, 2012

(65) Prior Publication Data

US 2012/0242907 A1 Sep. 27, 2012

(30) Foreign Application Priority Data

Mar. 24, 2011 (TW) ..... 100110100 A

(51) Int. Cl.
*G09G 5/00* (2006.01)
*G08C 17/02* (2006.01)

(52) U.S. Cl.
CPC ..... *G08C 17/02* (2013.01); *G08C 2201/20* (2013.01); *G08C 2201/91* (2013.01)
USPC ..... 345/156

(58) Field of Classification Search
CPC . G08C 17/02; G08C 2201/71; G08C 2201/32
USPC ..... 345/156–184
See application file for complete search history.

(56) References Cited

U.S. PATENT DOCUMENTS

| | | | | |
|---|---|---|---|---|
| 6,094,156 | A * | 7/2000 | Henty | 341/176 |
| 7,076,058 | B2 * | 7/2006 | Ikeuchi et al. | 379/433.12 |
| 7,142,420 | B2 * | 11/2006 | Santos et al. | 361/679.57 |
| 7,605,742 | B2 * | 10/2009 | Chuang et al. | 341/176 |
| D606,520 | S * | 12/2009 | McRae et al. | D14/218 |
| D628,987 | S * | 12/2010 | VanDuyn et al. | D14/218 |
| 8,054,295 | B2 * | 11/2011 | Henty | 345/169 |
| 8,508,482 | B2 * | 8/2013 | Van Der Byl | 345/169 |
| 8,648,803 | B2 * | 2/2014 | Maier et al. | 345/160 |
| 2005/0162569 | A1 * | 7/2005 | Fairhurst et al. | 348/734 |
| 2007/0129106 | A1 * | 6/2007 | Liu | 455/556.1 |

(Continued)

FOREIGN PATENT DOCUMENTS

| | | |
|---|---|---|
| CN | 101815161 A | 8/2010 |
| EP | 2175343 A1 | 4/2010 |
| TW | 200723726 | 6/2007 |

OTHER PUBLICATIONS

Office action mailed on Jun. 26, 2013 for the Taiwan application No. 100110100, filing date: Mar. 24, 2011, p. 1 line 5-14, p. 2-7 and p. 8 line 1-18.

*Primary Examiner* — Patrick F Marinelli
(74) *Attorney, Agent, or Firm* — Winston Hsu; Scott Margo

(57) ABSTRACT

The present relates to a remote control method and a remote control system capable of switching different pointing modes. The remote control method includes a detecting unit of a remote control detecting a relative position between a first module and a second module of the remote control so as to generate a detecting signal, transmitting a pointing mode code to an electronic device according to the detecting signal by wireless communication technology, and the electronic device performing movement of an icon according to the pointing mode code and pointing mode relation information.

5 Claims, 11 Drawing Sheets

(56) References Cited

U.S. PATENT DOCUMENTS

2007/0139172 A1* 6/2007 Watanabe et al. ..... 340/426.13
2008/0246733 A1* 10/2008 Henty ..... 345/168
2009/0207134 A1* 8/2009 Spilo ..... 345/158
2012/0161946 A1* 6/2012 Ida et al. ..... 340/13.24
2012/0206355 A1* 8/2012 Maier et al. ..... 345/160
2012/0262374 A1* 10/2012 Lai et al. ..... 345/158

* cited by examiner

REMOTE CONTROL SYSTEM AND METHOD CAPABLE OF SWITCHING DIFFERENT POINTING MODES

BACKGROUND OF THE INVENTION

1. Field of the Invention

The present invention relates to a remote control system capable of switching different pointing modes, and more particularly, to a remote control system capable of switching different pointing modes according to different relative positions and orientations thereof.

2. Description of the Prior Art

Recently, in order to meet the demands for televisions with more and more functions (such as a network television) or for digital home theaters such as a set-top box, a multi-media player, a blue-ray player and so on, various new remote controls have been developed. For example, as for a network navigator is built in the set-top box, it needs a pointing interface for operating the network navigator. While there are demands for searching webpages or keying in a website address, it needs an input interface. Some products are equipped with a wireless mouse and a keyboard for non-directional pointing operation and input, and some products have devices equipped with non-directional pointing components such as a touch panel or a trackball. However, for the user's perspective, a common drawback of the above-mentioned remote controls is that various components such as multi-media control keys, mouse components and a keyboard are all disposed on the same interface. It confuses the user as using such a remote control with various keys. For example, the user may not be clear about each function of the keys, and even most of the keys are used less. Furthermore, if the operating direction of a cursor on the television system can not be switched according to orientation of the remote control (e.g. vertically-oriented or horizontally-oriented), it causes the operating direction of the remote control inconsistent with the moving direction of the cursor on the television. Consequently, it results in inconvenience for using. Thus, it becomes an important issue for the remote control system and the remote control method to be more operable and user-friendly.

SUMMARY OF THE INVENTION

The present invention provides a remote control system and method capable of switching different pointing modes for solving above drawbacks.

According to the claimed invention, a remote control system includes a remote control including a first module whereon a first input interface is disposed, a second module installed on a side of the first module in a slidable manner relative to the first module, a second input interface and a pointing interface being disposed on the second module, a detecting unit for detecting a relative position between the first module and the second module, so as to generate a detecting signal, a first wireless transmission module for transmitting wireless signals, and a control module coupled to the detecting unit and the first wireless transmission module for controlling the first wireless transmission module to output a pointing mode code according to the detecting signal. The remote control system further includes an electronic device including a display module for displaying an icon, a memory module for storing the pointing mode code and a pointing mode relation information of the pointing interface, a second wireless transmission module for receiving the pointing mode code transmitted from the first wireless transmission module, and a logic unit coupled to the display module, the memory module and the second wireless transmission module for performing movement of the icon displayed on the display module according to the pointing mode code received by the second wireless transmission module and the pointing mode relation information stored by the memory module.

According to the claimed invention, a remote control method includes a detecting unit of a remote control detecting a relative position between a first module and a second module of the remote control, so as to generate a detecting signal, transmitting a pointing mode code to an electronic device according to the detecting signal by wireless communication technology, and the electronic device performing movement of an icon according to the pointing mode code and a pointing mode relation information.

In summary, the remote control system and the method of the present invention can switch different pointing modes according to relative positions of the different modules and orientations thereof. Consequently, it can achieve various operations of pointing modes (e.g. horizontal operation and vertical operation) by one single pointing interface according to system requirement, instead of disposing upward, downward, leftward, rightward keys with non-directional pointing components as a pointing interface for different pointing modes. Furthermore, when the remote control is opened and the interface underneath is used, the upper pointing interface can be synchronously used for executing upward, downward, leftward, rightward operations exactly. As a result, the present invention provides the remote control system and the remote control method with being more operable and user-friendly.

These and other objectives of the present invention will no doubt become obvious to those of ordinary skill in the art after reading the following detailed description of the embodiment that is illustrated in the various figures and drawings.

DETAILED DESCRIPTION

Figure 1:
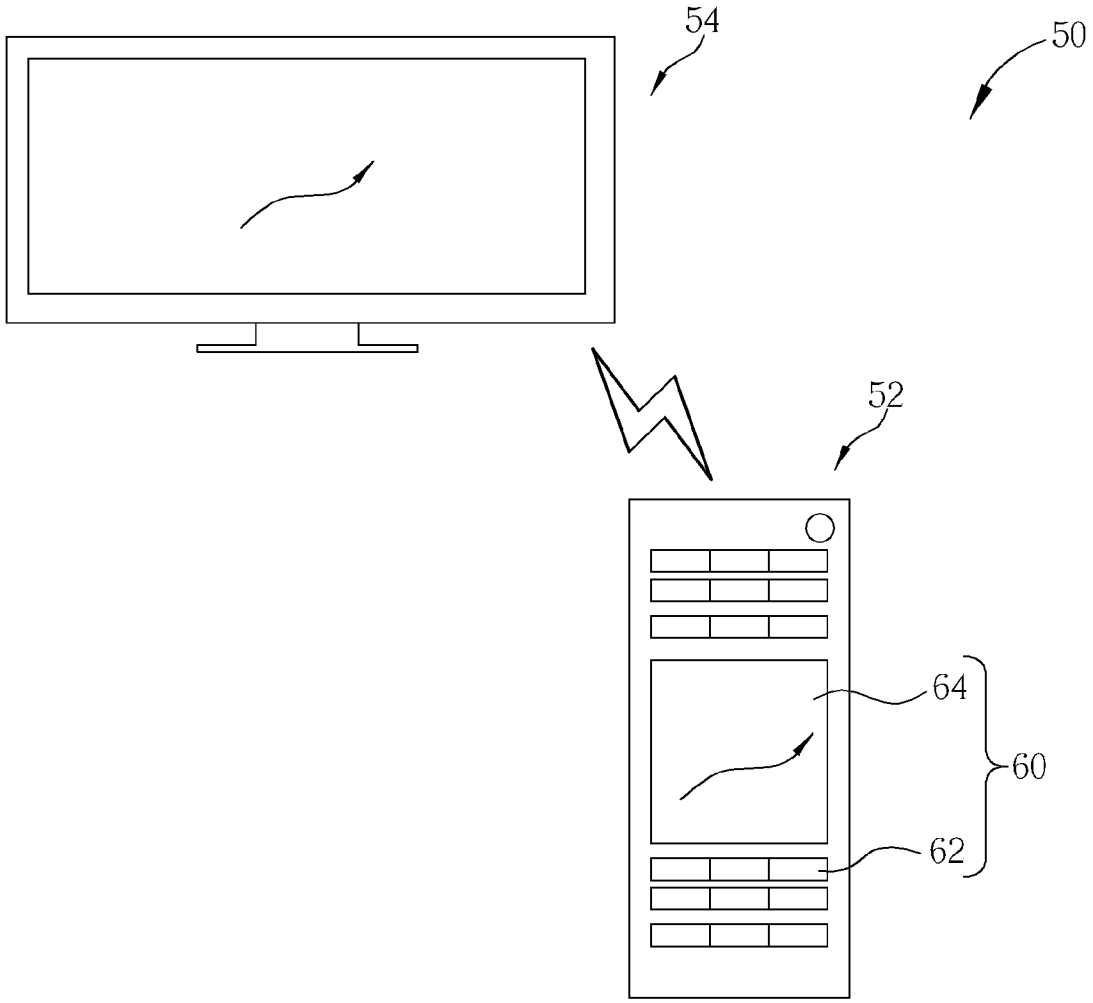
FIG. 1 is a diagram of a remote control system according to an embodiment of the present invention.
Figure 2:
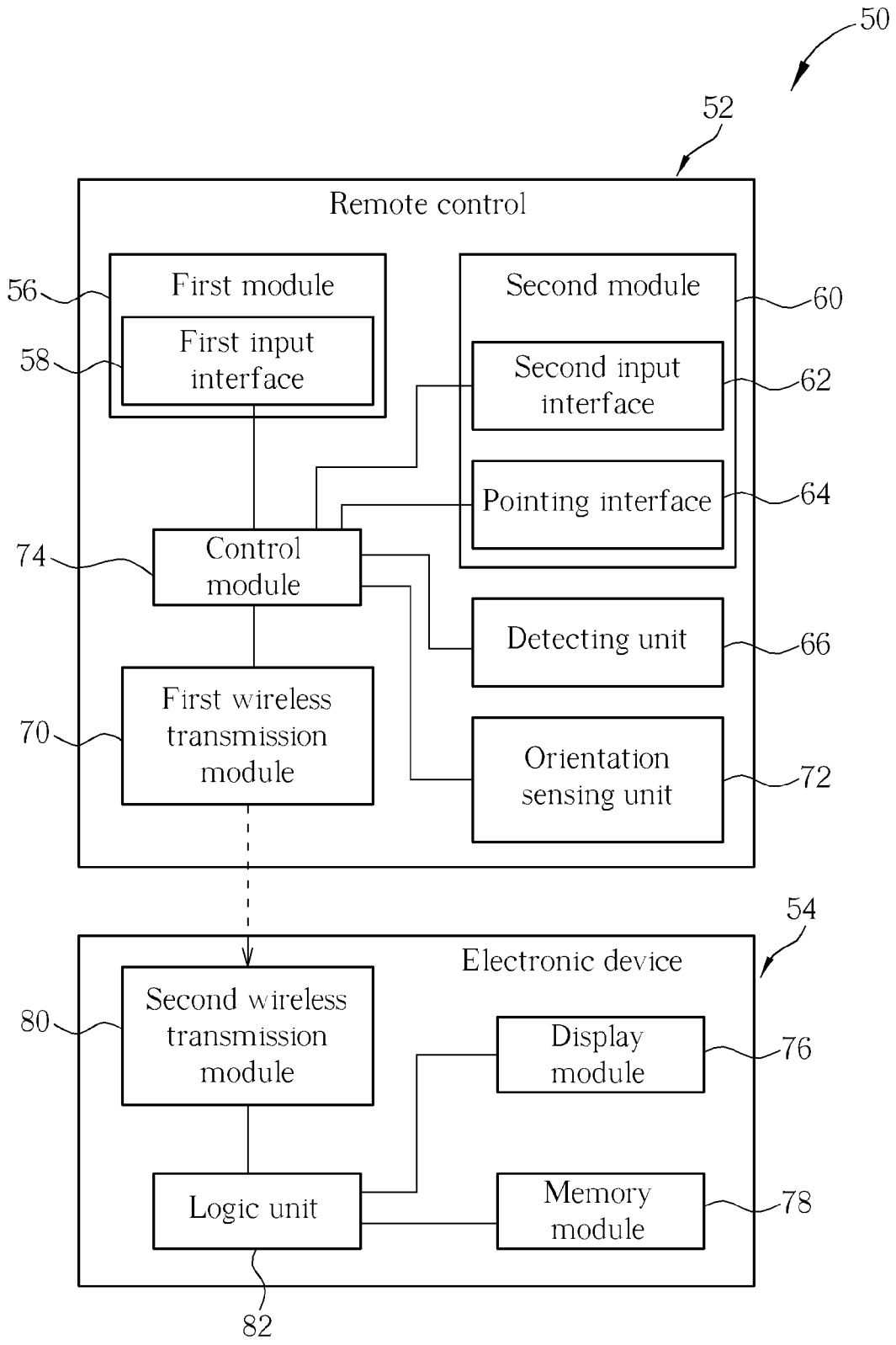
FIG. 2 is a functional block diagram of the remote control system according to the embodiment of the present invention.
Figure 3:
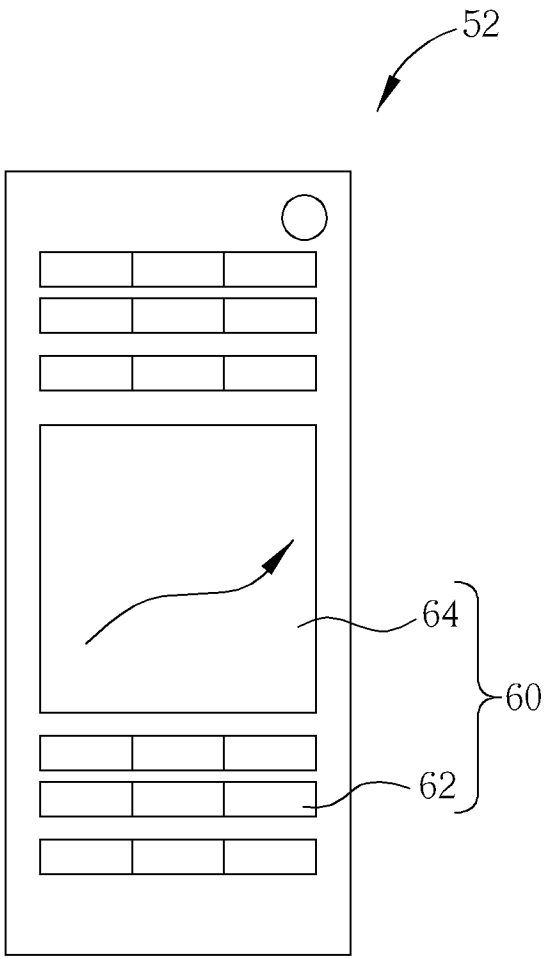
FIG. 3 and FIG. 4 are respectively diagrams of a remote control in different states according to the embodiment of the present invention.
Figure 4:
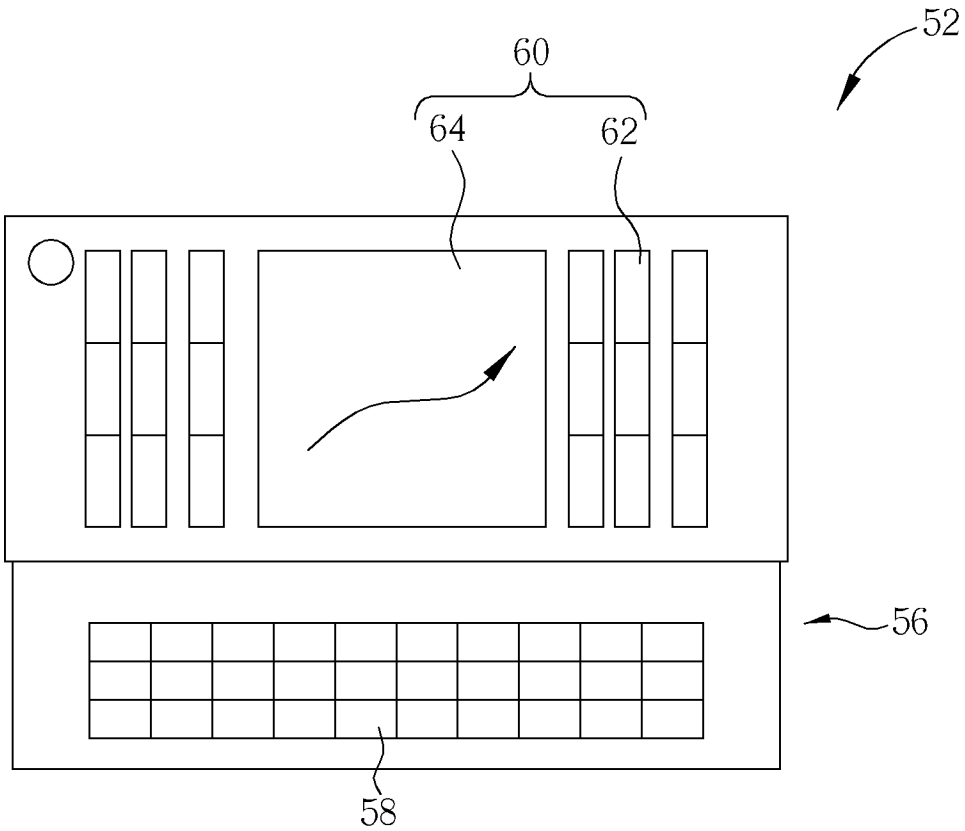

Please refer to FIG. 1 and FIG. 2. FIG. 1 is a diagram of a remote control system 50 according to an embodiment of the present invention. FIG. 2 is a functional block diagram of the remote control system 50 according to the embodiment of the present invention. The remote control system 50 includes a remote control 52 for remotely controlling an electronic device 54. The electronic device 54 can be a television device (e.g. a network television), a computer device and so on. Please refer to FIG. 1 to FIG. 4. FIG. 3 and FIG. 4 are respectively diagrams of the remote control 52 in different states according to the embodiment of the present invention. The remote control 52 includes a first module 56 whereon a first input interface 58 is disposed. For example, the first input interface 58 can include a plurality of keys for a user to perform searching function or inputting a website address. The remote control 52 includes a second module 60 installed on a side of the first module 56 in a slidable manner relative to the first module 56. A second input interface 62 and a pointing interface 64 are disposed on the second module 60. For example, the second input interface 62 can include a plurality of multi-media control keys such as a selection key, a volume key, a play key and so on. The pointing interface 64 can execute direction control by non-directional pointing components, such as a touch control panel, a joystick, a trackball and so on, or by four-direction keys.

In FIG. 3, the first module 56 and the second module 60 slide relatively to a first position. In other words, the second module 60 and the first module 56 are in a closed position. In FIG. 4, the first module 56 and the second module 60 slide relatively to a second position. In other words, the second module 60 and the first module 56 are in an opened position. In general, the second input interface 62 of the second module 60 is equipped with the multi-media control keys often used, and the first input interface 58 of the first module 56 is equipped with keys on a keyboard rarely used. Accordingly, when the user only uses the remote control 52 to remotely control multi-media playing, the second module 60 can be slid to the first position relative to the first module 56, and only the second input interface 62 is operated. Consequently, it can reduce volume occupied by the remote control 52. When the user needs the keys on the keyboard for data input, the second module 60 can be slid to the second position relative to the first module 56, so as to expose the first input interface 58 for the user to input data.

Figure 5:
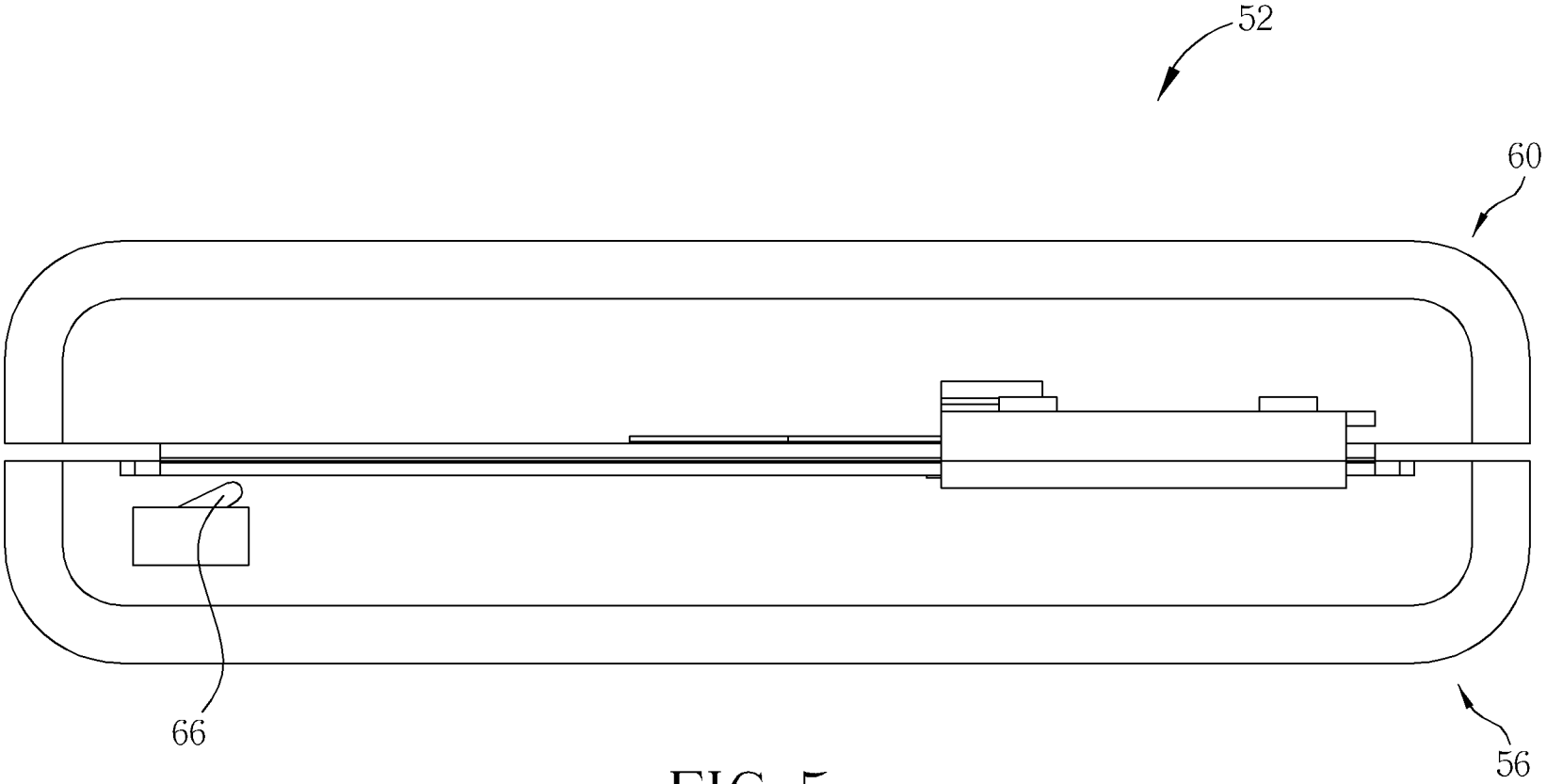
FIG. 5 to FIG. 10 are respectively internal structural diagrams illustrating that a first module and a second module slide relatively to different positions according to the embodiment of the present invention.
Figure 6:
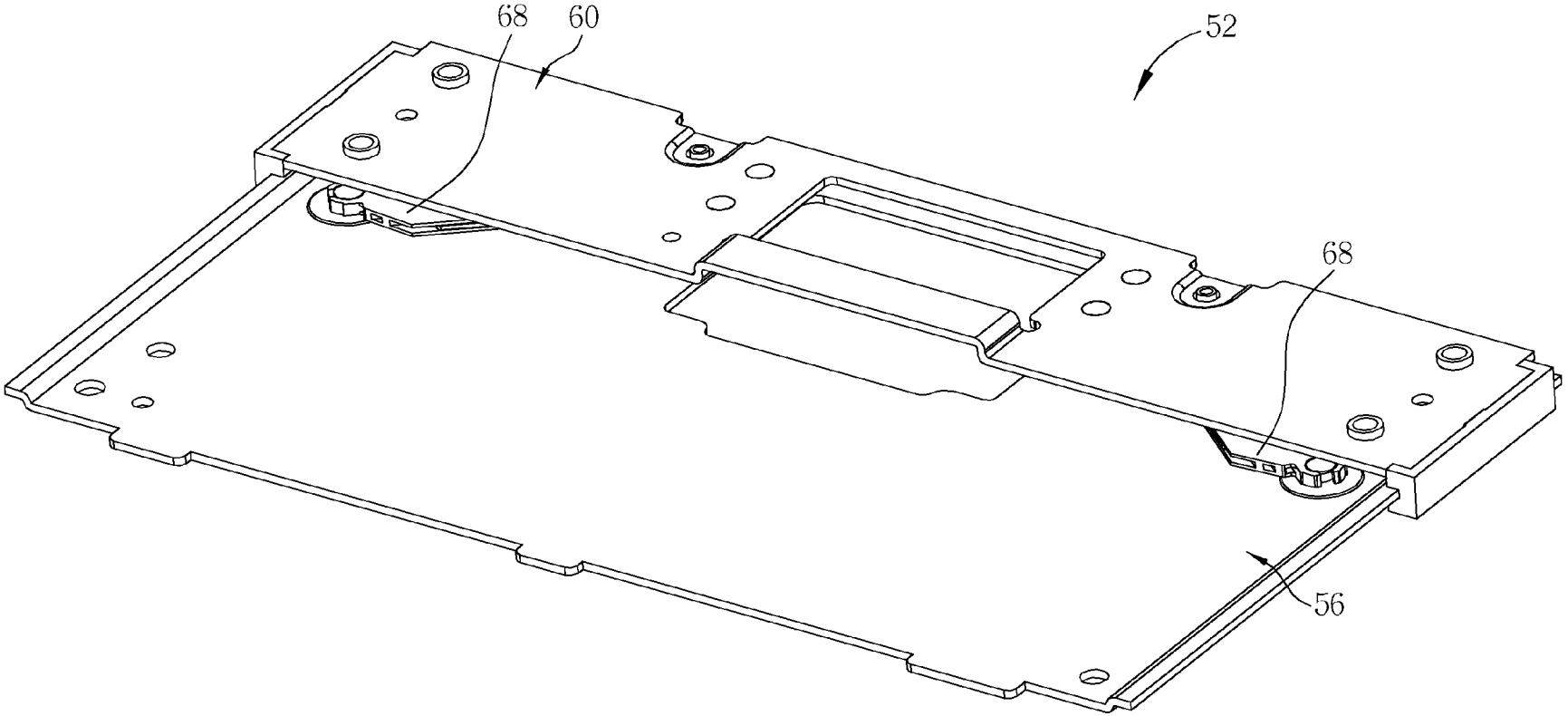
Figure 7:
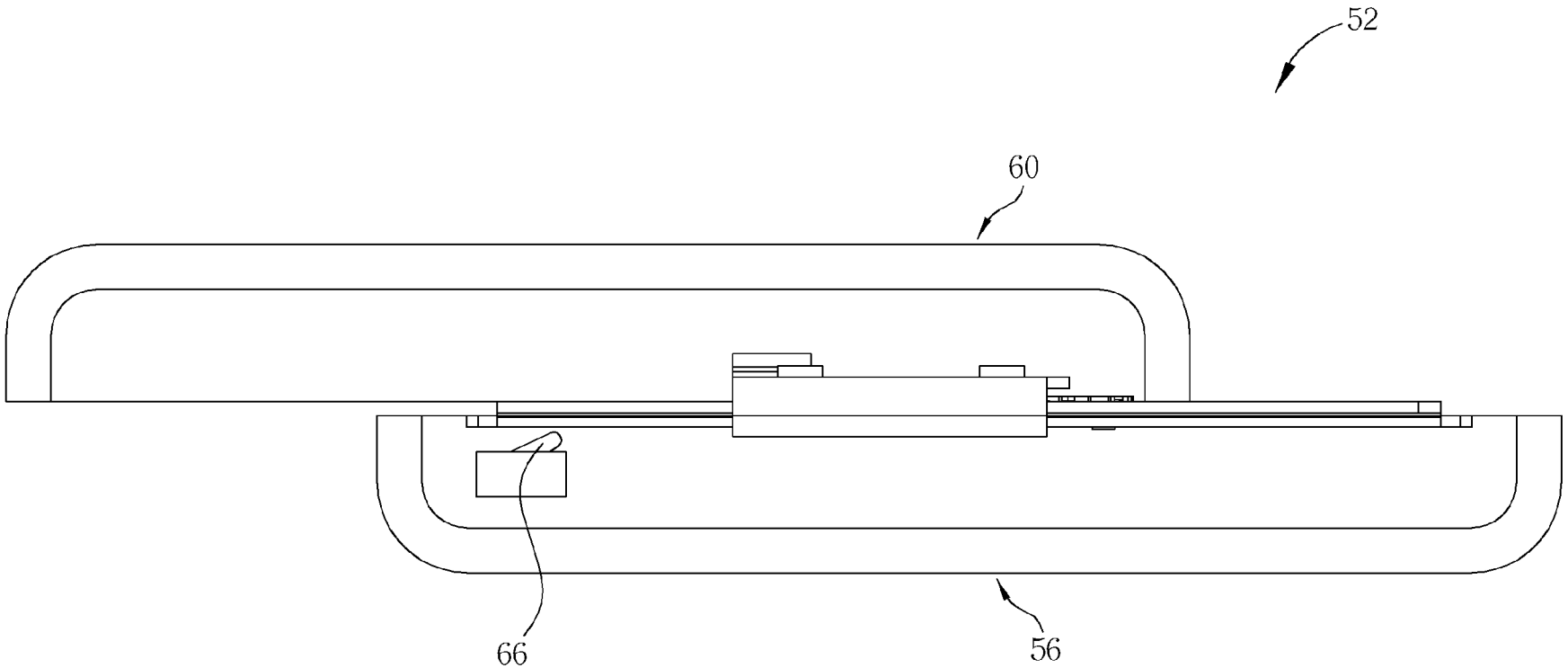
Figure 8:
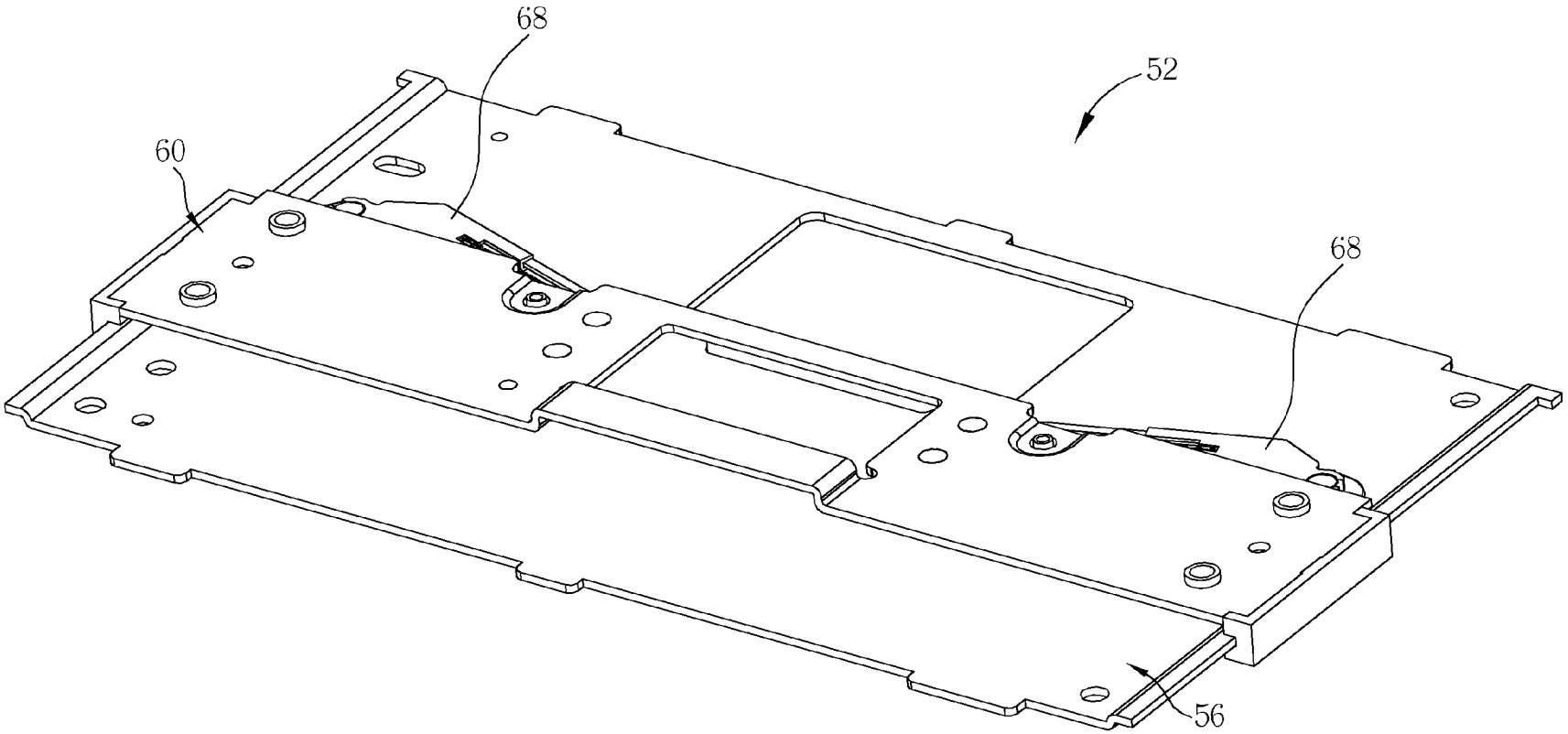
Figure 9:
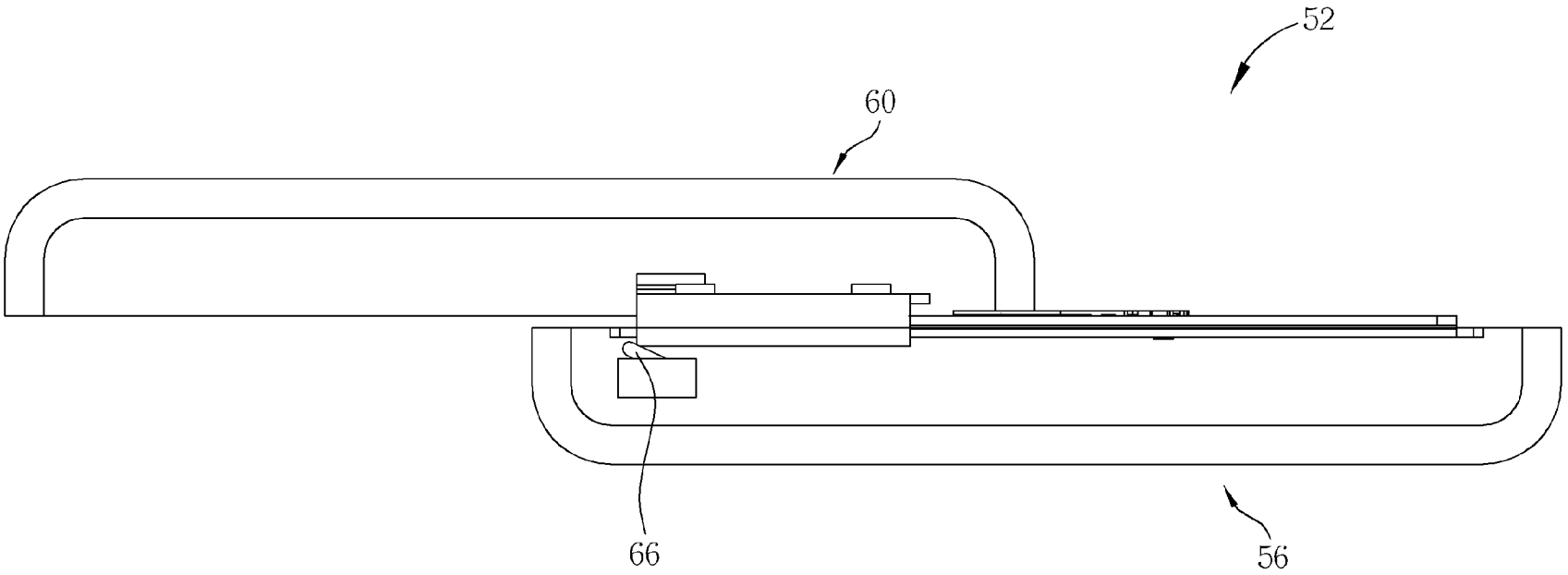
Figure 10:
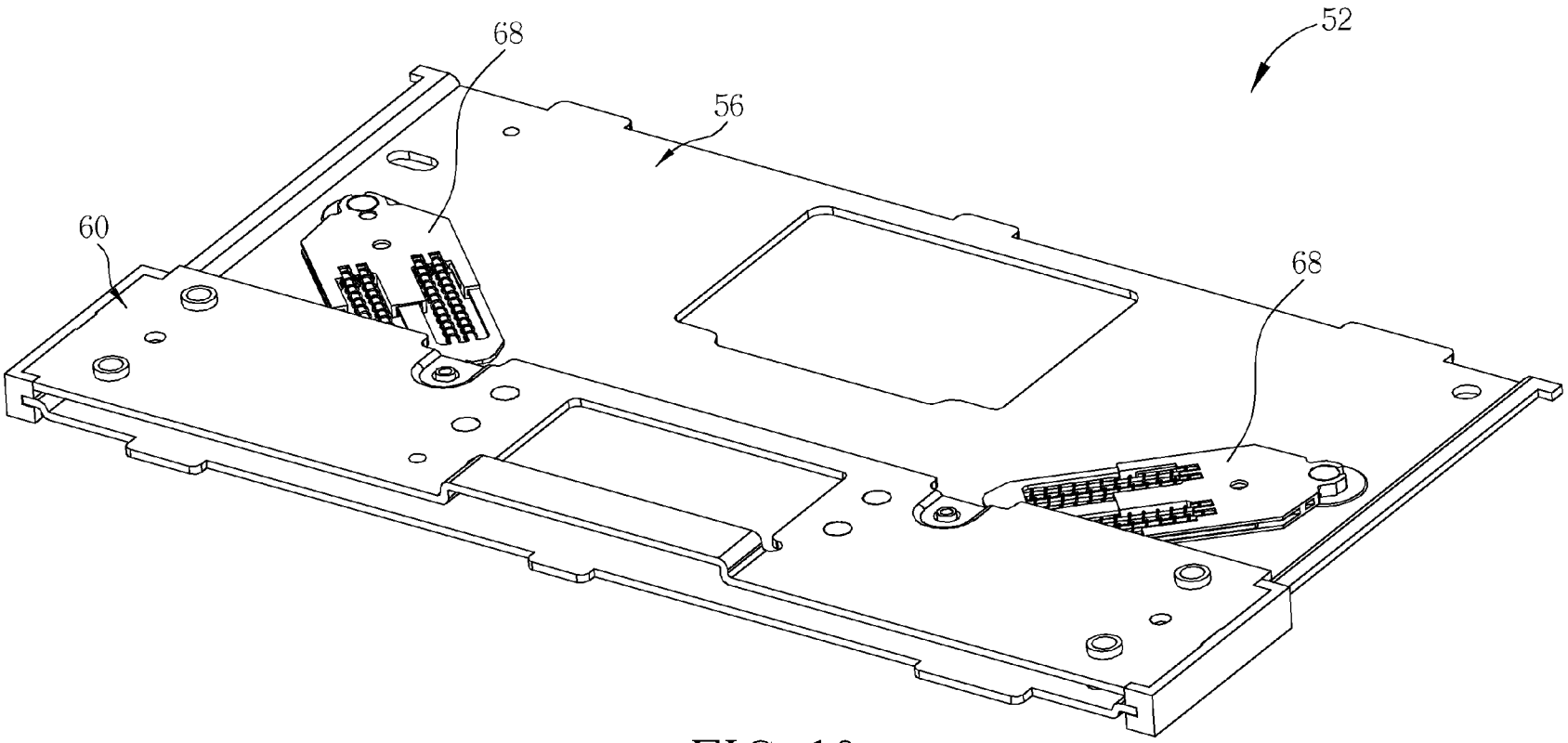

Furthermore, the remote control 52 further includes a detecting unit 66 for detecting a relative position between the first module 56 and the second module 60, so as to generate a detecting signal correspondingly. Please refer to FIG. 5 to FIG. 10. FIG. 5 to FIG. 10 are respectively internal structural diagrams illustrating that the first module 56 and the second module 60 slide relatively to different positions according to the embodiment of the present invention. For example, the detecting unit 66 can be a switch which is pushed to be activated so as to generate the detecting signal when the first module 56 and the second module 60 slide relatively to each other. Two driving modules 68 (such as torsion springs) can be used for sliding the first module 56 and the second module 60. As the second module 60 is pushed from the closed position of the first module 56 and the second module 60 (as shown in FIG. 5 and FIG. 6) via a half-opened position of the first module 56 and the second module 60 (as shown in FIG. 7 and FIG. 8) and finally to the opened position of the first module 56 and the second module 60 (as shown in FIG. 9 and FIG. 10), a structural component connected to the second module 60 can actuate the detecting unit 66, so as to generate the detecting signal correspondingly. In such a manner, change of the relative position between the first module 56 and the second module 60 can be detected. In other words, the detecting unit 66 can be used for detecting which of the first position or the second position the first module 56 slides relative to the second module 60, so as to generate the detecting signal correspondingly. Except for the above-mentioned embodiment, the present invention can utilize other detecting mechanism such as an optical sensor or a magnetic spring switch, so as to detect the relative position between the first module 56 and the second module 60. Mechanisms capable of detecting the relative position between the first module 56 and the second module 60 are within the scope of the present invention.

Please refer to FIG. 2 again. The remote control 52 further includes a first wireless transmission module 70 for transmitting wireless signals. The remote control 52 further includes an orientation sensing unit 72 for sensing whether the first module 56 and the second module 60 are vertically oriented or horizontally oriented, so as to output an orientation signal correspondingly. In this embodiment, the orientation sensing unit 72 can be a G-sensor. In other words, the orientation sensing unit 72 can determine whether the remote control 52 is vertically oriented or horizontal oriented according to the orientation that the user holds on the remote control 52. The remote control 52 further includes a control module 74 coupled to the detecting unit 66, the first wireless transmission module 70 and the orientation sensing unit 72. The control module 74 is used for controlling the first wireless transmission module 70 to output a pointing mode code according to the detecting signal or according to the detecting signal together with the orientation detecting signal simultaneously.

In addition, the electronic device 54 includes a display module 76 for displaying an icon. For example, the display module 76 can be a display monitor for displaying the icon such as a cursor. The electronic device 54 further includes a memory module 78 for storing the pointing mode code and a pointing mode relation information of the pointing interface 64. Which of the pointing modes that the icon displayed by the display module 76 and the pointing interface 64 correspond to can be determined by the pointing mode relation information when the electronic device 54 receives the pointing mode code. The electronic device 54 further includes a second wireless transmission module 80 for receiving the pointing mode code transmitted from the first wireless transmission module 70. The first wireless transmission module 70 and the second wireless transmission module 80 can transmit the wireless signals with a wireless network protocol of an infrared ray technology or a Bluetooth technology. The electronic device 54 further includes a logic unit 82 coupled to the display module 76, the memory module 78 and the second wireless transmission module 80. The logic unit 82 is used for performing movement of the icon displayed on the display module 76 according to the pointing mode code received by the second wireless transmission module 80 and the pointing mode relation information stored by the memory module 78.

Figure 11:
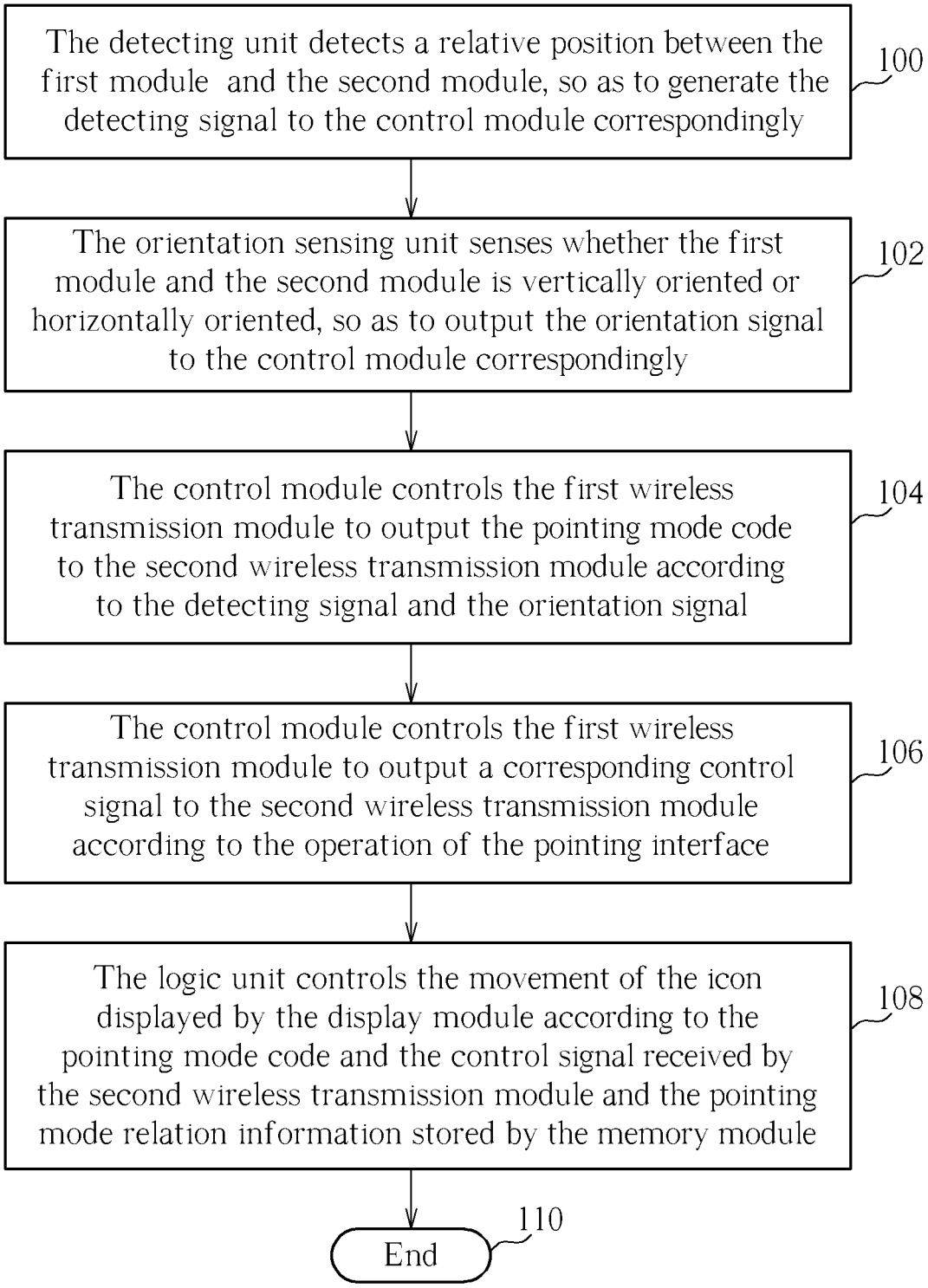
FIG. 11 is a flowchart of a remote control method for the remote control system to switch different pointing modes according to the embodiment of the present invention.

Please refer to FIG. 11. FIG. 11 is a flow chart of a remote control method for the remote control system 50 to switch different pointing modes according to the embodiment of the present invention. The remote control method includes following steps:

Step 100: The detecting unit 66 of the remote control 52 detects a relative position between the first module 56 and the second module 60, so as to generate the detecting signal to the control module 74 correspondingly.

Step 102: The orientation sensing unit 72 senses whether the first module 56 and the second module 60 is vertically oriented or horizontally oriented, so as to output the orientation signal to the control module 74 correspondingly.

Step 104: The control module 74 controls the first wireless transmission module 70 to output the pointing mode code to the second wireless transmission module 80 of the electronic device 54 according to the detecting signal and the orientation signal.

Step 106: The control module 74 controls the first wireless transmission module 70 to output a corresponding control signal to the second wireless transmission module 80 of the electronic device 54 according to the operation of the pointing interface 64.

Step 108: The logic unit 82 controls the movement of the icon displayed by the display module 76 according to the pointing mode code and the control signal received by the second wireless transmission module 80 and the pointing mode relation information stored by the memory module 78.

Step 110: End.

More detailed description for the above-mentioned steps is provided as follows. Since the detecting unit 66 of the remote control 52 can utilize the aforesaid mechanism to detect the relative position between the first module 56 and the second module 60, so as to generate the detecting signal to the control module 74 correspondingly. The pointing mode of the pointing interface 64 can be determined in accordance with whether the first module 56 and the second module 60 are in the closed state or in the opened state. Furthermore, at the same time, the orientation sensing unit 72 can sense whether the first module 56 and the second module 60 are vertically oriented or horizontally oriented, so as to output the orientation signal to the control module 74. The pointing mode of the pointing interface 64 can be determined in accordance with whether the first module 56 and the second module 60 are vertically oriented or horizontally oriented as well. Afterwards, the control module 74 can control the first wireless transmission module 70 to output the corresponding pointing mode code to the second wireless transmission module 80 of the electronic device 54 according to the detecting signal and the orientation signal. For example, when the first module 56 and the second module 60 slide relatively to the first position and the first module 56 and the second module 60 are vertically oriented, the first wireless transmission module 70 outputs the pointing mode code corresponding to a first pointing mode. When the first module 56 and the second module 60 slide relatively to the second position and the first module 56 and the second module 60 are horizontally oriented, the first wireless transmission module 70 outputs the pointing mode code corresponding to a second pointing mode. When the first module 56 and the second module 60 slide relatively to the second position and the first module 56 and the second module 60 are vertically oriented, the first wireless transmission module 70 outputs the pointing mode code corresponding to the first pointing mode. When the first module 56 and the second module 60 slide relatively to the first position and the first module 56 and the second module 60 are horizontally oriented, the first wireless transmission module 70 outputs the pointing mode code corresponding to the first pointing mode. In other words, the first wireless transmission module 70 outputs the pointing mode code corresponding to the second pointing mode only when the conditions of that the first module 56 and the second module 60 slide relatively to the second position (i.e. the opened position) and that the first module 56 and the second module 60 are horizontally oriented are true. Otherwise, the first wireless transmission module 70 outputs the pointing mode code corresponding to the first pointing mode. In this embodiment, the operating direction of the first pointing mode differs from that of the second pointing mode by 90 degrees. It should be noticed that determining conditions of the present invention are not limited to those mentioned above, and they can depend on design demands. Afterwards, if the user operates the pointing interface 64 such as performing cursor movement or multi-touch control, the control module 74 can control the first wireless transmission module 70 to output the corresponding control signal to the second wireless transmission module 80 of the electronic device 54 according to the movement of the pointing interface 64 operated by the user.

After the second wireless transmission module 80 of the electronic device 54 receives the pointing mode code and the control signal transmitted from the first wireless transmission module 70 of the remote control 52, the logic unit 82 of the electronic device 54 can control the movement of the icon displayed by the display module 76 according to the pointing mode code, the control signal and the pointing mode relation information stored by the memory module 78. In order to switch the pointing mode of the pointing interface 64 of the remote control 52 according to the opened/closed states of the remote control 52 and orientation states of the remote control 52, the logic unit 82 of the electronic device 54 can switch the movement direction corresponding to the icon displayed on the display module 76 when the user operates the pointing interface 64 in accordance with the pointing mode code with the information corresponding to the opened/closed states of the remote control 52 and the orientation states of the remote control 52. In other words, when the first module 56 and the second module 60 slide relatively to the second position (i.e. the opened position) and the remote control 52 is horizontally oriented, the electronic device 54 switches the pointing mode of the pointing interface 64 to the second pointing mode. In this mode, the user can operate the pointing interface 64 in a manner that the remote control 52 is horizontally oriented, and the icon displayed on the display module 76 moves in a direction corresponding to the operating direction exactly. On the contrary, when the first module 56 and the second module 60 slide relatively to the first position (i.e. the closed position) and the remote control 52 is vertically oriented, the electronic device 54 switches the pointing mode of the pointing interface 64 to the first pointing mode. In this mode, the user can operate the pointing interface 64 in a manner that the remote control 52 is vertically oriented, and the icon displayed on the display module 76 moves in a direction corresponding to the operating direction exactly. In other words, the operating direction of the first pointing mode differs from that of the second pointing mode by 90 degrees on the same pointing interface 64.

As mentioned above, when the user opens the remote control 52 (the first module 56 and the second module 60 slide relatively to the opened position), it implies that the user needs to hold the remote control 52 horizontally and type on the first input interface 58. In order to confirm the aforesaid motions to be an error motion or still not to be horizontally operated more exactly, the remote control 52 can be equipped with an additional sensor for detecting orientation states. In other words, when the first module 56 and the second module 60 sliding relatively to the opened position and sensing the first module 56 and the second module 60 to be horizontally oriented are both true, the pointing mode of the pointing interface 64 will be switched to the second pointing mode, i.e. the upward, the downward, the leftward and the rightward operation of the pointing mode conforming to horizontal orientation of the remote control 52. Otherwise, the pointing mode of the pointing interface 64 will be switched to the first pointing mode, i.e. the upward, the downward, the leftward and the rightward operation of the pointing mode conforming to vertical orientation of the remote control 52. In such a manner, the operating direction corresponding to the pointing interface 64 can be switched to avoid difficult in use due to difference between the operating direction of the pointing interface 64 and the movement direction of the icon displayed by the display module 76. It should be noticed that matching conditions of the different pointing modes for the opened/closed states of the remote control 52 with the orientation of the remote control 52 are not limited to those mentioned in the above-mentioned embodiment, and it depends on design demands.

Compared with the prior art, the remote control system and the method of the present invention can switch different pointing modes according to relative positions of the different modules and orientations thereof. Consequently, it can achieve various operations of pointing modes (e.g. horizontal operation and vertical operation) by one single pointing interface according to system requirement, instead of disposing upward, downward, leftward, rightward keys with non-directional pointing components as a pointing interface for different pointing modes. Furthermore, when the remote control is opened and the interface underneath is used, the upper pointing interface can be synchronously used for executing upward, downward, leftward, rightward operations exactly. As a result, the present invention provides the remote control system and the remote control method with being more operable and user-friendly.

Those skilled in the art will readily observe that numerous modifications and alterations of the device and method may be made while retaining the teachings of the invention.

What is claimed is:

1. A remote control system, comprising:

a remote control, comprising:

a first module whereon a first input interface is disposed;

a second module installed on a side of the first module in a slidable manner relative to the first module, a second input interface and a pointing interface being disposed on the second module;

a detecting unit for detecting a relative position between the first module and the second module, so as to generate a detecting signal;

a first wireless transmission module for transmitting wireless signals;

an orientation sensing unit for sensing whether the first module and the second module are vertically oriented or horizontally oriented, so as to output an orientation signal; and a control module coupled to the detecting unit and the first wireless transmission module for controlling the first wireless transmission module to output a pointing mode code according to the detecting signal and the orientation signal; and an electronic device, comprising:

a display module for displaying an icon;

a memory module for storing the pointing mode code and a pointing mode relation information of the pointing interface;

a second wireless transmission module for receiving the pointing mode code transmitted from the first wireless transmission module; and a logic unit coupled to the display module, the memory module and the second wireless transmission module for performing movement of the icon displayed on the display module according to the pointing mode code received by the second wireless transmission module and the pointing mode relation information stored by the memory module, wherein the relative position between the first module and the second module is either a first position, in which the second module and the first module are in a closed state, or a second position, in which the first module and the second module are in an open state, wherein the control unit outputs the pointing mode code, to control and move the icon displayed on the display module, according to one of a first pointing mode and a second pointing mode, different from the first pointing mode, based on the detecting signal and the orientation signal, wherein the control unit controls the first wireless transmission module to only output the pointing mode code according to the first pointing mode when the detecting signal indicates the relative position to be in the first position and the orientation signal indicates the first module and the second module are vertically oriented, and when the detecting signal indicates the relative position to be in the second position and the orientation signal indicates the first module and the second module are vertically oriented, and wherein the control unit controls the first wireless transmission module to only output the pointing mode code according to the second pointing mode when the detecting signal indicates the relative position to be in the first position and the orientation signal indicates the first module and the second module are horizontally oriented, and when the detecting signal indicates the relative position to be in the second position and the orientation signal indicates the first module and the second module are horizontally oriented.

2. The remote control system of claim 1, wherein a controlling direction of the first pointing mode differs from a controlling direction of the second pointing mode by 90 degrees.

3. The remote control system of claim 1, wherein the detecting unit is a switch being pushed to generate the detecting signal when the first module and the second module move relatively.

4. The remote control system of claim 1, wherein the remote control further comprises at least one driving module for driving the second module to slide relative to the first module.

5. The remote control system of claim 4, wherein the driving module is a torsion spring.

* * * * *